US009360023B2

(12) United States Patent
Yahner

(10) Patent No.: US 9,360,023 B2
(45) Date of Patent: Jun. 7, 2016

(54) HYDRAULIC REGENERATION SYSTEM AND METHOD FOR A MATERIAL HANDLING VEHICLE

(71) Applicant: The Raymond Corporation, Greene, NY (US)

(72) Inventor: Joseph T. Yahner, Chenango Forks, NY (US)

(73) Assignee: The Raymond Corporation, Greene, NY (US)

( * ) Notice: Subject to any disclaimer, the term of this patent is extended or adjusted under 35 U.S.C. 154(b) by 569 days.

(21) Appl. No.: 13/803,861

(22) Filed: Mar. 14, 2013

(65) Prior Publication Data

US 2014/0260222 A1 Sep. 18, 2014

(51) Int. Cl.

| | |
|---|---|
| ***F15B 1/02*** | (2006.01) |
| ***B66F 9/22*** | (2006.01) |
| ***F15B 21/14*** | (2006.01) |

(52) U.S. Cl.

CPC ... *F15B 1/02* (2013.01); *B66F 9/22* (2013.01); *F15B 21/14* (2013.01); *F15B 2211/20569* (2013.01); *F15B 2211/30565* (2013.01); *F15B 2211/353* (2013.01); *F15B 2211/40515* (2013.01); *F15B 2211/41581* (2013.01); *F15B 2211/625* (2013.01); *F15B 2211/6346* (2013.01); *F15B 2211/665* (2013.01); *F15B 2211/6654* (2013.01); *F15B 2211/7052* (2013.01); *F15B 2211/75* (2013.01); *F15B 2211/761* (2013.01)

(58) Field of Classification Search

CPC ..... F15B 1/02; F15B 21/14; B66F 9/22; B66F 9/24

USPC ..... 60/414, 459; 91/454; 414/814

See application file for complete search history.

(56) References Cited

U.S. PATENT DOCUMENTS 5,313,873 A * 5/1994 Gall ..... F15B 1/02 137/596.17
6,837,045 B2 * 1/2005 Heusser ..... B66F 9/22 60/403

(Continued)

FOREIGN PATENT DOCUMENTS

EP 0908413 A2 * 4/1999 ..... B66F 9/22
EP 1193211 A2 4/2002

(Continued)

OTHER PUBLICATIONS

JH0228498A, Toyoda Automatic Loom Works, English Abstract, 2 pages, Jan. 5, 2015.

(Continued)

*Primary Examiner* — Thomas E Lazo
(74) *Attorney, Agent, or Firm* — Quarles & Brady LLP

(57) ABSTRACT

A hydraulic system has a cylinder and ram assembly that raises and lowers a load carrying carriage on a material handling vehicle. The fluid exhausting from the cylinder, while the carriage is lowering, is controlled to recover energy from that fluid. A first path routes the exhausting fluid to drive the pump as a hydraulic motor. A second path routes the exhausting fluid to a reservoir, bypassing the pump. In a first lowering mode, the second path is closed and the first path is opened. In a second lowering mode, both the first and second paths are open and the flow through each one is proportionally controlled. In a third lowering mode, only the second path is opened. The mode to use is selected based on the desired lowering speed of the carriage.

20 Claims, 2 Drawing Sheets

(56) References Cited

U.S. PATENT DOCUMENTS

| | | | | |
|---|---|---|---|---|
| 7,240,771 | B2 | 7/2007 | Perkins | |
| 7,444,809 | B2 | 11/2008 | Smith et al. | |
| 2004/0060430 | A1* | 4/2004 | Brinkman | E02F 9/2217 91/361 |
| 2007/0166168 | A1 | 7/2007 | Vigholm | |
| 2007/0169473 | A1 | 7/2007 | Esders | |
| 2008/0152513 | A1* | 6/2008 | Esders | B66F 9/22 417/411 |
| 2013/0183127 | A1* | 7/2013 | Dammeyer | B66F 9/075 414/592 |
| 2014/0331662 | A1* | 11/2014 | Ueda | B66F 9/22 60/431 |

FOREIGN PATENT DOCUMENTS

| | | | |
|---|---|---|---|
| EP | 2333351 | A1 | 6/2011 |
| JP | H0228498 | A | 1/1990 |

OTHER PUBLICATIONS

Extended European Search Report, 14159517.3-1705, 8 pages, May 26, 2014.

English language translation of description portion of EP 0908413 A2; Apr. 14, 1999; Still Wagner GmbH & Co KG; 9 pages.

* cited by examiner

HYDRAULIC REGENERATION SYSTEM AND METHOD FOR A MATERIAL HANDLING VEHICLE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to material handling vehicles, such as lift trucks and reach trucks, that have electrically operated components and a hydraulic system; and more particularly to techniques for recovering energy from the hydraulic system to power the electrically operated components.

2. Description of the Related Art

Certain material handling vehicles have electric motors for driving and steering the wheels that propel the vehicle across the floor of a manufacturing plant, a warehouse or similar facility. These material handling vehicles also have a hydraulic system for raising and lowering a load carrier, such as a pair of forks or a platform. The hydraulic system has an electric motor that operates a pump which supplies pressurized fluid. The pressurized fluid is controlled by a valve assembly to operate a hydraulic cylinder and ram assembly to raise the load carrier.

The load carrier is lowered by the force of gravity. The rate of lowering is controlled by opening a valve in a manner that proportionally controls the flow of fluid out of the cylinder to a reservoir. The fluid flows out of the cylinder under pressure due to the force of gravity acting on the load carrier and any load thereon. That pressure is reduced to the atmospheric level upon the fluid entering the reservoir. Therefore the energy contained in that exhausting pressurized fluid is lost.

Some material handling vehicles have a mechanism for recovering the energy in that exhausting fluid. Instead of routing that fluid directly to the reservoir, the fluid is directed backwards through the pump to the reservoir, thereby driving the pump as a hydraulic motor. Driving the pump in that manner also drives the electric motor coupled to the pump causing the electric motor to act as a generator. The resulting electricity that is generated is either used to power other active devices on the material handling vehicle or used to recharge a vehicle battery.

A drawback of this energy recovery technique occurs at flow rates of the fluid exhausting from the hydraulic cylinder. Excessively high flow can drive the pump and electric motor at too great a speed resulting in excessive wear on both devices. Very high speed also generates electric frequencies that may adversely affect the excitation system on the vehicle.

Therefore, there is a desire to be able to recover energy from the exhausting fluid at high flow rates without adversely affecting the pump-motor combination.

SUMMARY OF THE INVENTION

A material handling vehicle has body and a carriage for carrying a load being transported, wherein the carriage is raised and lowered with respect to the body. A hydraulic system on the vehicle includes a reservoir, a pump that draws fluid from the reservoir and provides the fluid under pressure to an pump outlet, and a hydraulic cylinder and ram assembly that has a cylinder port and is mechanically connected to raise and lower the carriage. The hydraulic system further includes an electrically operated, proportional first valve that selectively controls a first path through which fluid flows between the pump outlet and the cylinder port, and an electrically operated, proportional return valve that selectively controls a second path through which fluid flows between the cylinder port and the reservoir, bypassing the pump.

The hydraulic system operates in a plurality of modes to lower the carriage. In a first mode, the return valve is closed and the first valve is open to direct fluid to flow from the cylinder port to the pump outlet. In this lowering mode, the pump operates as a hydraulic motor. In a second mode, the return valve is open to direct some fluid to flow through the second path from the cylinder port to the reservoir, and in which the first valve is open to direct other fluid to flow from the cylinder port to the pump outlet, thereby operating the pump as a hydraulic motor. Operating the pump as a hydraulic motor in both the first and second modes, causes the pump to recover energy from the fluid exiting the cylinder through the cylinder port. In one example, the pump drives an attached electric motor to generate electricity that can be used to power other electrical functions on the material handling vehicle and to recharge the vehicle battery.

In another embodiment, the hydraulic system selectively operates in a third mode in which the first valve is held closed and the return valve is open to direct all the fluid from the cylinder port through the second path to the reservoir.

Another aspect of the present invention provides logic for selecting which of the three modes to use to lower the carriage at a particular time. The first mode is selected when a desired speed for lowering the load carriage is less than a first level. The second mode is selected when the desired speed for lowering the load carriage is greater than the first level and less than a second level. The third mode is selected when the desired speed for lowering the load carriage is greater than the second level. As a further variation, the third mode is selected when the desired speed is greater than the second level, the load carriage is above a given height, and a load on the load carriage has less than a given weight.

DETAILED DESCRIPTION OF THE INVENTION

Figure 1:
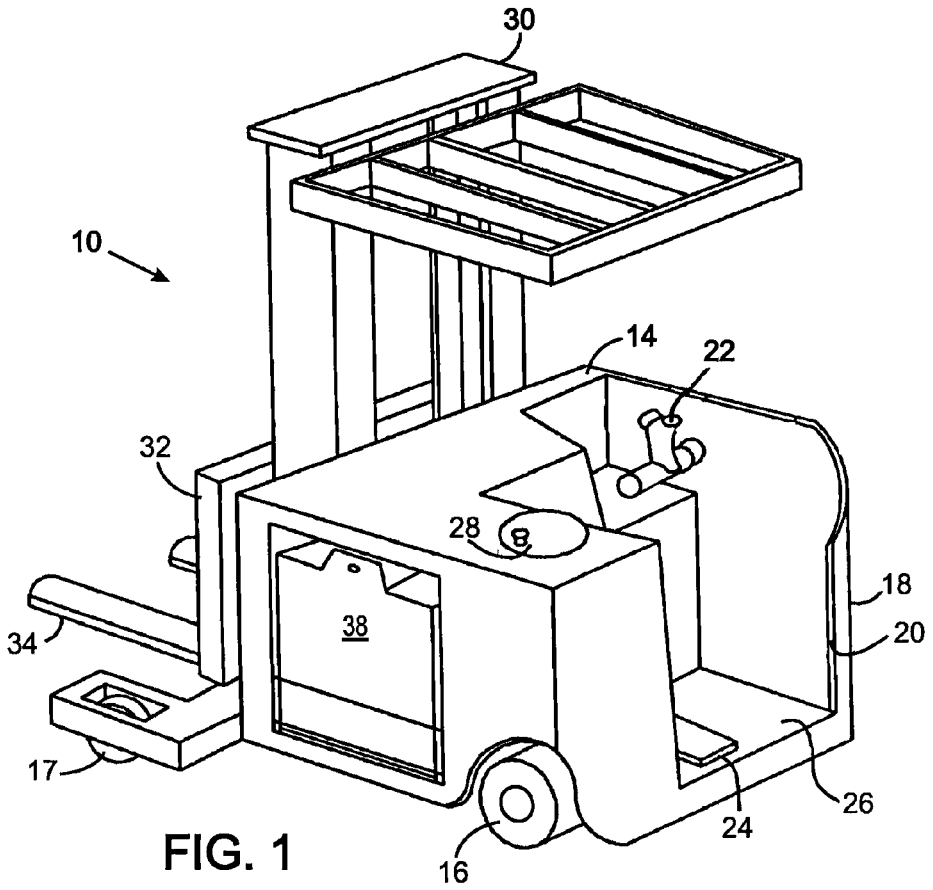
FIG. 1 is a perspective view of a material handling vehicle incorporating the present invention.

Referring initially to FIG. 1, a material handling vehicle 10, such as a lift truck, includes body 14 mounted on wheels 16 and 17 for movement across a floor of a warehouse or a factory, for example. The body includes an operator compartment 18 with an opening 20 for entry and exit of the operator. The operator compartment 18 contains a multi-function control handle 22 and a deadman switch 24 positioned on the floor 26. The deadman switch 24 must be closed by the operator's foot before any of the motors on the material handling vehicle can operate, which prevents run away operation of the vehicle. A steering wheel 28 is also provided in the operator compartment 18. Although the material handling vehicle 10 is shown by way of example as having a standing, fore-aft operator stance configuration, the present invention is not limited to vehicles of this type, and can also be used with other kinds of material handling vehicles including, without limitation, pallet trucks, platform trucks, sideloaders, swing reach trucks, counterbalanced fork lift vehicles, orderpickers, stacker/retrieval machines, tow tractors, and other powered vehicles used in a warehouse or a factory to transport, store, and retrieve items.

The material handling vehicle 10 includes a vertical mast 30 secured to the body 14 with a carriage 32 is slideably mounted to the mast for vertical movement between different positions. A pair of forks 34 form a load carrier that extends from the carriage 32 to support a load 50 (FIG. 2) that is being transported. By manipulating the multi-function control handle 22, the operator controls the raising and lowering of the carriage 32 on the vertical mast 30. The mast 30 has multiple sections that telescope as the carriage 32 is raised. The mast has a minimum height when fully collapsed and all the sections are retracted.

Figure 2:
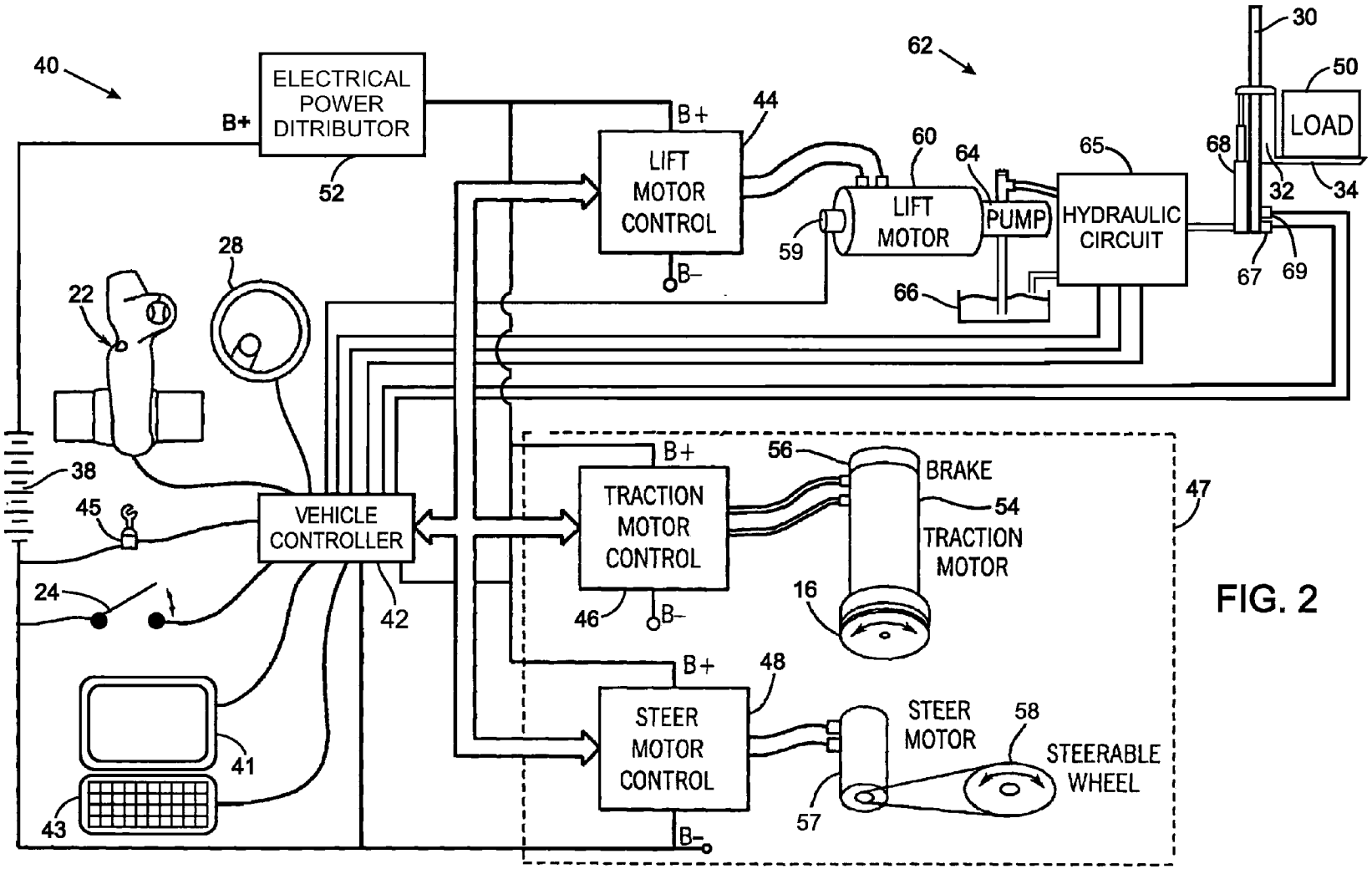
FIG. 2 is a schematic diagram of the control system for the material handling vehicle.

With reference to FIG. 2, the multi-function control handle 22 and steering wheel 28 are part of a control system 40 for the material handling vehicle 10. The control system 40 includes a vehicle controller 42 that is a microcomputer based device for executing software which controls operation of other components on the vehicle. A conventional information display 41 and a keyboard 43 enable the operator to interface with the vehicle controller 42. The vehicle controller 42 also receives operator input signals from the multi-function control handle 22, the steering wheel 28, a key switch 45, and the deadman switch 24. In response to those received signals, the vehicle controller 42 provides command signals to a lift motor control 44 and a propulsion system 47 that includes both a traction motor control 46 and a steer motor control 48. The propulsion system 47 provides a motive force for propelling and steering the material handling vehicle 10 in a selected direction, while the lift motor control 44 governs motion of the carriage 32 along a mast 30 to raise or lower the load 50, as described below. The material handling vehicle 10 and its control system 40 are powered by one or more batteries 38, coupled to the vehicle controller 42, propulsion system 47, and lift motor control 44 through a bank of fuses or circuit breakers in an electrical power distributor 52. Although a battery powered material handling vehicle is being used in the disclosure herein, the present invention also can be used on a vehicle that is powered by an internal combustion engine or a fuel cell.

The traction motor control 46 activates an electric traction motor 54 that is connected to the wheel 16 to provide motive force to the material handling vehicle 10. The speed and direction of the traction motor 54 are selected by operation of the multi-function control handle 22. The wheel 16 is also connected to friction brake 56 through the traction motor 54, thereby providing both a service and parking brake functions for the material handling vehicle 10. The steer motor control 48 is connected to operate a steer motor 57 and associated steerable wheel 58, in response to the operator rotating the steering wheel 28. The direction of rotation of the steerable wheel 58 and the travel control command from multi-function control handle 22 determine the direction of motion of the material handling vehicle across the floor of a facility in which the vehicle is used.

Operation of the multi-function control handle 22 also designates the speed at which operator desires to raise and lower the carriage 32. The vehicle controller responds to that designation by sending a command to the lift motor control 44. The lift motor control 44 controls application of electric current to a hydraulic lift motor 60 that is connected to a hydraulic system 62. The hydraulic system 62 propels the carriage 32 and forks 34 along the vertical mast 30, thereby moving the load 50 up or down, depending on the direction selected at the multi-function control handle 22. The lift motor 60 drives a fixed positive displacement pump 64 that produces flow of fluid from a reservoir 66 to a hydraulic cylinder and ram assembly 68 connected between the body 14 of the material handling vehicle and the carriage 32. A hydraulic circuit 65 comprises a valve assembly that controls flow of fluid from the pump 64 to the cylinder and ram assembly 68 to raise the carriage 32 and at other times controls flow of fluid from the cylinder and ram assembly back to the reservoir 66. The valve assembly is electrically operated by signals from the vehicle controller 42.

A speed sensor 59 provides a signal to the vehicle controller 42 indicating the speed of the hydraulic lift motor 60. A height sensor 67 detects the height to which the carriage 32 is raised above a lowermost position closest to the floor. A weight sensor 69 detects the weight of any load 50 that is present on the carriage 32.

Figure 3:
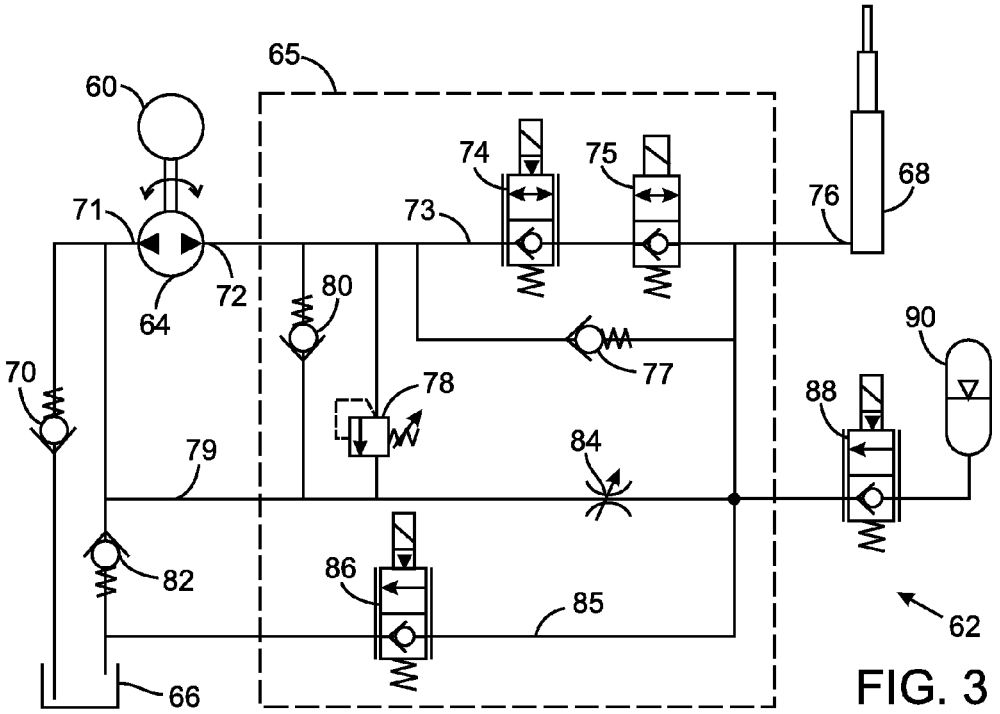
FIG. 3 is a schematic diagram of the hydraulic circuit in the control system.

With reference to FIG. 3, the hydraulic circuit 65 includes a fluid reservoir 66 connected through an inlet check valve 70 to an inlet 71 of the pump 64. A first path 73 connects an outlet 72 of the pump 64 to a cylinder port 76 of the hydraulic cylinder and ram assembly 68. That first path 73 is provided by first and second valves 74 and 75 that are connected in series and are electrically operated by signals from the vehicle controller 42. The first valve 74 is a proportional valve that provides high resolution of flow control and the second valve 75 is a two position valve with open and closed positions. Many types of proportional valves have some degree of leakage that is undesirable in this application. As a consequence, the second valve 75, which has relatively low leakage, is provided to prevent flow of fluid between the pump outlet 72 and the hydraulic cylinder and ram assembly 68 when such flow is not desired. Alternatively, the second hydraulic valve 75 could be eliminated if the first valve 74 has relatively low leakage in the closed state. A supply check valve 77 is connected in parallel with both the first and second solenoid valves 74 and 75 and allows flow of fluid in a direction from the pump outlet 72 to the cylinder port 76.

A pressure relief valve 78 is connected between the pump outlet 72 and a reservoir return line 79 and opens when pressure at the pump outlet exceeds a predefined level. An outlet check valve 80 is connected so as to provide a path that allows fluid to flow only in a direction from the reservoir return line 79 to the pump outlet 72. A return check valve 82 opens to allow fluid flow either from the reservoir return line 79 or the inlet 71 to the reservoir 66. A manually operated valve 84 is connected between the cylinder port 76 and the reservoir return line 79 and is operated to lower the load carriage 32 in the event of a loss of electrical power on the material handling vehicle 10 or another situation in which the load carriage 32 cannot be lowered normally.

An electrically operated, proportional return valve 86 is connected in a second path 85 between the cylinder port 76 and the reservoir 66 and is operated by an signal from the vehicle controller 42. The return valve 86 provides a relatively large passage for fluid to flow there through and thus when fully opened, produces a negligible pressure drop to that flow of fluid. An electrically operated, auxiliary valve 88 has a port connected to the cylinder port 76 and another port to an accumulator 90. The electrically operated valves 74, 75, 86 and 88 are controlled by signals from the vehicle controller 42 that includes the appropriate drive circuits for producing the requisite electric current levels necessary to operate those valves.

To raise the carriage 21, the operator manipulates the multi-function control handle 22 which sends the appropriate electrical command to the vehicle controller 42. The vehicle controller responds by commanding the lift motor control 44 to energize the lift motor 60, thereby driving the pump 64. The speed of the motor, and thus the speed of the pump is regulated to control the rate at which the carriage raises. This produces a flow of pressurized fluid at the outlet 72 of the pump 64. That pressurized fluid forces the supply check valve 77 to open causing the fluid to continue to flow into the cylinder port 76. That flow then causes the ram to extend out of the cylinder raising the carriage 33 and, if necessary, extending the mast 30. If desired, the vehicle controller 42 may also open the first and second solenoid valves 74 and 75 to open the first path 73 for fluid to flow from the pump outlet 72 to the cylinder port 76.

When the carriage 32 reaches the desired height, the operator manipulates the multi-function control handle 22 to signal the vehicle controller 42 to terminate raising the carriage 32. In response, the vehicle controller commands the lift motor control 44 to de-energize the lift motor 60 thereby de-activating the pump 64. If during the raising operation, the first and second solenoid valves 74 and 75 were opened, both those valves are now closed by the vehicle controller 42. Closure of those valves and the supply check valve 77 prevent fluid from flowing from the cylinder port 76 back through the pump 64.

The process for lowering the load carrying carriage 32, varies depending upon the desired lowering speed as indicated by operation of the multi-function control handle 22. The speed of the carriage 32 determines the rate at which fluid flows out of the cylinder port 76 during the lowering operation. If practical, that flow is applied to the outlet 72 of the hydraulic pump 64 to operate the pump in a motoring mode which uses the energy of the fluid to drive the electric lift motor 60, which thereby acts as a generator. The electricity generated by the electric lift motor 60 is applied by the lift motor control 44 to power other electrical functions on the material handling vehicle 10 and to recharge the battery 38.

When operation of the multi-function control handle 22 designates a lowering speed (S) below a first threshold level (L1), i.e., S<L1, a first lowering mode is chosen. In that first lowering mode, the vehicle controller 42 only the first and second valves 74 and 75 are opened to enable fluid exiting through the cylinder port 76 to flow via the first path 73 through the pump 64, out the pump inlet 71, and through return check valve 82 to the reservoir 66. The non-proportional second valve 75 is opened fully, while the position of the proportional first solenoid valve 74 is opened to proportionally control the fluid flow and thus the lowering speed of the carriage 32 as desired by the vehicle operator. The return valve 86 is held closed in the first lowering mode.

When the multi-function control handle 22 designates a lowering speed above the first threshold level and below a second threshold level (L2), i.e., L1<S<L2, vehicle controller 42 selects a second lowering mode. In the second mode, the first and second valve 74 and 75 are opened and the return valve 86 is opened. The first valve 74 and the return valve 86 are proportionally opened to apportion the amount of the flow exiting through from the cylinder port between the first and second paths 73 and 85. That apportionment control the amount of the flow through the first path so that the pump will not be driven as a motor at an excessive high speed. In addition, electric current from the battery 38 can be applied to the lift motor 60 to produce a opposing force that prevents overspeed of the pump-motor combination. The speed of the pump-motor combination is measured by a sensor 59.

A third lowering mode is active when the multi-function control handle 22 designates a lowering speed above the second threshold level, i.e., L2<S, and the carriage 32 is above a first height. As a safeguard, the load also must be less than a first weight so that the carriage 32 does not drop too fast. In the third lowering mode, vehicle controller 42 opens the return valve 86 fully so that all the flow exiting through from the cylinder port flows to the reservoir via the second path 85. Since a negligible amount of fluid will flow through the first path when the relatively large return valve 86 is fully open, the first and second valve 74 and 75 can be closed in the third lowering mode.

If the multi-function control handle 22 designates a lowering speed above the second level, but either the carriage 32 is below the first height or the load is heavier than the first weight, the vehicle controller 42 selects the first lowering mode.

Thus the present lowering method routes fluid from the cylinder to drive the pump as a hydraulic motor whenever practical. Under lowering condition that could overdrive the pump at too high a speed some or all of the fluid from the cylinder is routed around the pump to the reservoir. This lowering method enables energy to be recovered under a wide range of carriage lower speeds without overdriving the pump.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. A hydraulic system for a material handling vehicle that has body and a carriage for carrying a load being transported, said hydraulic system comprising:

a hydraulic cylinder and ram assembly operatively connected to raise and lower the carriage with respect to the body and having a cylinder port;

a reservoir;

a pump operatively connected to draw fluid from the reservoir and provide the fluid under pressure to an pump outlet, the pump operable as a hydraulic motor;

a proportional first valve that is electrically operated and that selectively controls a first path through which fluid flows between the pump outlet and the cylinder port;

a proportional return valve that is electrically operated and that selectively controls a second path through which fluid flows between the cylinder port and the reservoir bypassing the pump;

a speed sensor that detects a speed of the hydraulic motor;

wherein the hydraulic system operates in a plurality of modes to lower the carriage comprising:

(a) a first mode in which the return valve is closed and the first valve is open to direct fluid to flow from the cylinder port into the pump outlet, thereby operating the pump as the hydraulic motor; and (b) a second mode in which the return valve is open to direct fluid to flow through the second path from the cylinder port to the reservoir, and in which the first valve is open to direct fluid to flow from the cylinder port into the pump outlet, thereby operating the pump as the hydraulic motor, wherein an apportionment of flow through the first valve and the return valve is controlled in response to the speed of the hydraulic motor.

2. The hydraulic system as recited in claim 1 further comprising an electrically operated second valve connected in the first path in series with the first valve.

3. The hydraulic system as recited in claim 1 further comprising an inlet check valve operatively connected to provide an inlet path through which fluid flows from the reservoir to an inlet port of the pump.

4. The hydraulic system as recited in claim 1 further comprising a return check valve operatively connected to an inlet port of the pump and providing a return path through which fluid flows from the pump to the reservoir.

5. The hydraulic system as recited in claim 1 further comprising a supply check valve operatively connected to provide a third path through which fluid flows from the pump outlet to the cylinder port.

6. The hydraulic system as recited in claim 1 further comprising an accumulator; and an electrically operated accumulator valve for controlling fluid flow between the cylinder port and the accumulator.

7. The hydraulic system as recited in claim 1 further comprising a third mode for lowering the load carriage in which the first valve is closed and the return valve is open to direct fluid to flow from the cylinder port to the reservoir.

8. The hydraulic system as recited in claim 1 further comprising:

an inlet check valve operatively to provide an inlet path through which fluid flows from the reservoir to an inlet port of the pump;

a return check valve operatively connected to provide a return path through which fluid flows from the inlet port to the reservoir; and a supply check valve operatively connected to provide a third path through which fluid flows from the pump outlet to the cylinder port.

9. A method for operating a hydraulic system that has a reservoir, a pump having an inlet connected to the reservoir and having an outlet, the pump operable as a hydraulic motor, a speed sensor that detects a speed of the hydraulic motor, a hydraulic cylinder and ram assembly having a cylinder port and operatively connected to raise and lower a load carriage on a material handling vehicle, a first path for fluid to flow between the outlet and the cylinder port, and a second path for fluid to flow between the cylinder port and the reservoir bypassing the pump; said method comprising:

(a) lowering the load carriage in a first mode in which the second path is closed and the first path is open to direct fluid to flow from the cylinder port to the outlet, thereby operating the pump as the hydraulic motor; and (b) lowering the load carriage in a second mode in which the second path is open to direct fluid to flow from the cylinder port to the reservoir, and in which the first path is open to direct fluid to flow from the cylinder port to the pump outlet thereby operating the pump as the hydraulic motor, wherein an apportionment of flow through the first path and the second path is controlled in response to the speed of the hydraulic motor.

10. The method as recited in claim 9 wherein lowering the load carriage in the first mode comprises closing a return valve to close the second path.

11. The method as recited in claim 9 wherein lowering the load carriage in the first mode comprises opening a first valve to open the first path.

12. The method as recited in claim 9 wherein lowering the load carriage in the second mode comprises opening a proportional first valve to open the first path; and opening a proportional return valve to open the second path.

13. The method as recited in claim 12 wherein the apportionment of flow comprises opening the proportional first valve and the proportional return valve to limit operation of the hydraulic motor to less than a given speed.

14. The method as recited in claim 9 wherein:

the first mode is selected when a desired speed for lowering the load carriage is less than a first level; and the second mode is selected when a desired speed for lowering the load carriage is greater than the first level and less than a second level.

15. The method as recited in claim 9 further comprising lowering the load carriage in a third mode in which the second path is open to direct fluid to flow from the cylinder port to the reservoir, and the first path is closed.

16. The method as recited in claim 15 wherein lowering the load carriage in the third mode comprises opening a return valve to open the second path.

17. The method as recited in claim 15 wherein:

the first mode is selected when a desired speed for lowering the load carriage is less than a first level;

the second mode is selected when the desired speed for lowering the load carriage is greater than the first level and less than a second level; and the third mode is selected when the desired speed for lowering the load carriage is greater than the second level.

18. The method as recited in claim 17 wherein the third mode is selected when desired speed is greater than the second level and the load carriage is above a given height.

19. The method as recited in claim 17 wherein the third mode is selected when desired speed is greater than the second level and a load on the load carriage has less than a given weight.

20. The method as recited in claim 17 wherein the first mode is selected when desired speed is greater than the second level and an occurrence of at least one of the load carriage is above a given height and a load on the load carriage has less than a given weight.

* * * * *